US009875858B2

(12) United States Patent
Montgomery et al.

(10) Patent No.: US 9,875,858 B2
(45) Date of Patent: Jan. 23, 2018

(54) LOCKOUT DEVICE AND A METHOD FOR ITS USE

(71) Applicants: Brad Montgomery, Janesville, WI (US); David Johnson, Brooksville, FL (US)

(72) Inventors: Brad Montgomery, Janesville, WI (US); David Johnson, Brooksville, FL (US)

( * ) Notice: Subject to any disclaimer, the term of this patent is extended or adjusted under 35 U.S.C. 154(b) by 0 days.

(21) Appl. No.: 14/546,561

(22) Filed: Nov. 18, 2014

(65) Prior Publication Data

US 2015/0206668 A1 Jul. 23, 2015

Related U.S. Application Data

(63) Continuation-in-part of application No. 13/767,791, filed on Feb. 14, 2013, now Pat. No. 8,890,010.

(60) Provisional application No. 61/598,615, filed on Feb. 14, 2012.

(51) Int. Cl.
*H01H 9/28* (2006.01)

(52) U.S. Cl.
CPC ..... *H01H 9/283* (2013.01)

(58) Field of Classification Search
CPC ..... H01H 9/283; H01H 9/282; H01H 71/46
USPC ..... 200/43.01–43.22, 329–339, 304, 50.01, 200/50.4; 81/487; 269/166, 169, 6
See application file for complete search history.

(56) References Cited

U.S. PATENT DOCUMENTS

| | | | | |
|---|---|---|---|---|
| 4,926,722 | A | 5/1990 | Grant | |
| 5,504,284 | A * | 4/1996 | Lazareth et al. | 200/50.01 |
| 5,817,998 | A * | 10/1998 | Siebels et al. | 200/43.14 |
| 6,437,261 | B1 * | 8/2002 | Bryant et al. | 200/43.16 |
| 8,890,010 | B2 * | 11/2014 | Montgomery et al. | 200/43.21 |
| 2007/0220932 | A1 | 9/2007 | Meekma | |
| 2014/0165384 | A1 * | 6/2014 | Dudgeon et al. | 29/622 |

* cited by examiner

*Primary Examiner* — Edwin A. Leon
(74) *Attorney, Agent, or Firm* — Muskin & Farmer, LLC

(57) ABSTRACT

A lockout device for preventing an electrical switch from being turned either ON or OFF while the lockout device is attached to the switch. The present lockout device can be capable of quick and easy attachment to the switch and can be secured to the switch with a padlock or similar locking device. The present lockout device can also comprise a peg for attaching a lockout tag, which prevents the tag from being removed while the lockout device is connected to a switch.

24 Claims, 14 Drawing Sheets

LOCKOUT DEVICE AND A METHOD FOR ITS USE

CROSS REFERENCE TO RELATED APPLICATIONS

This application claims benefit to provisional patent application No. 61/598,615 filed Feb. 14, 2012 and the non-provisional patent application Ser. No. 13/767,791 filed Feb. 14, 2013, which are both incorporated by reference herein in their entirety.

FIELD OF THE INVENTION

The present lockout device and method for its use relates to the field of safety devices for use with electrical switches. Specifically, when connected to multiple circuit breaker switches or similar switches the present lockout device can prevent the switches from being moved from an OFF position to an ON position or vice versa without it first being disconnected from the switches.

BACKGROUND

Heavy machinery, which is typically connected to a power grid, must often be accessed or climbed upon in order to perform routine maintenance or repairs. One or more circuit breakers often control electrical power to such heavy machinery. When a worker enters or works upon this machinery, such circuit breakers are typically switched off in order to prevent it from being activated. Tragically, many workers have been killed or seriously injured when machinery has been activated either intentionally by people who do not realize that a worker or workers are inside the heavy machinery or unintentionally by people who accidentally come into contact with the circuit breaker switch, or similar switch and thus activate it.

Several lockout devices have been designed to prevent such accidental activations. See U.S. Patent Application 2004/0245077 by Benda as an example. Such lockout devices can be physically connected to the circuit breaker switch then locked into place through the use of a padlock or similar device. When properly installed, the lockout device cannot be removed, and the circuit breaker switch cannot be turned on or off, until the padlock has been disconnected from the lockout device. By allowing users of such lockout devices to have complete control over a machine's electrical power, work can safely be performed in or on the machine without fear that an accidental activation of the machine will occur.

However, many present lockout devices use thumbscrews or similar attachment mechanisms to connect the lockout device to the circuit breaker switch. These attachment mechanisms can be unwieldy and can take considerable time and effort to properly connect to a circuit breaker switch. This can waste a substantial amount of time and can result in a poor connection between the lockout device and the circuit breaker switch if the user becomes impatient, or lacks the fine motor skills required to operate small thumbscrews or similar devices.

Furthermore, existing lockout devices do not offer a lockout tag holder. Under current Occupational Safety and Health Administration (OSHA) regulations, a lockout tag identifying the owner of each lockout device must also accompany each device. Users of existing lockout devices typically attach their lockout tags to the padlocks used to secure each lockout device. However, this does not hold the lockout tags in any particular alignment and when multiple lockout tags are used in close proximity to one another, they can become disheveled, making them difficult to read.

Moreover, existing lockout devices do not offer the ability to lockout more than one circuit board switch. While many circuit board switches are singular and independent, higher current driving application require multiple circuit breakers to safely limit the power flow to those applications. In many instances, the multiple circuit breaker switches are joined into a single long switch. Existing lockout devices are neither sturdy enough nor configured properly to effectively lockout a multiple switch.

What is needed is a lockout device that can be quickly and easily connected to, or disconnected from circuit breaker switches, which can also comprise a lockout tag holder configured to neatly align multiple lockout tags in an arrangement that makes each easier to read.

SUMMARY OF THE INVENTION

It is an aspect of the present invention to provide a lockout device which can be quickly and easily connected to, or disconnected from circuit breaker switches or similar electrical switches, and it is a further aspect of the present invention to provide a lockout device comprising a lockout tag holder configured to neatly align multiple lockout tags in an arrangement that makes each easier to read.

The above aspects can be obtained by a lockout device comprising: a lockout device comprising: a housing comprising a housing opening; a frame located within the housing opening, wherein the frame comprises a front end further comprising a front frame opening and a rear end further comprising a rear frame opening, and the frame further comprising a rear clutch comprising a rear clutch opening connected to the rear end of the frame and a front clutch comprising a front clutch opening connected to the front end of the frame; a sliding bar having a first end and a second end, wherein a jaw, having multiple sets of jaw teeth is connected to the first end of the sliding bar and the second end of the sliding bar is configured to pass through the front clutch opening, the front frame opening, then the rear clutch opening, and the rear frame opening; and a handle having a first end and a second end, wherein the first end is pivotably connected to both the housing and the frame and is configured to move between an open configuration and a closed configuration, wherein movement of the handle from the open configuration to the closed configuration causes the jaw to move toward the frame.

The above aspects can also be obtained by a lockout device comprising: a lockout device comprising: a housing having a first end comprising a housing opening and a second end comprising a housing slot; a frame connected to the first end of the housing and located within the first housing opening, wherein the frame comprises a front end comprising an opening and a rear end comprising an opening, wherein frame teeth are connected to the rear end of the frame; a rear clutch, comprising an opening, located near the rear end of the frame and a front clutch, comprising an opening, located near the front end of the frame; a large spring located within the frame, the large spring configured to push the handle away from the frame thus holding the lockout device in an open configuration; a small spring located between the rear clutch and the rear end of the frame, the small spring configured to push the rear clutch away from the rear end of the frame; a sliding bar having a first end and a second end, wherein a jaw comprising multiple sets of jaw teeth is connected to the first end of the slide bar and the second end of the slide bar is configured to pass through openings in the rear clutch, rear frame, front clutch, and front frame; and a handle having a first end and a second end, wherein the first end is pivotably attached to both the housing and the frame and is configured to move between an open configuration and a closed configuration, and wherein movement of the handle from the open configuration to the closed configuration causes the jaw to move toward the frame, and wherein a loophole, located at the second end of the handle is configured to pass through the housing slot when the handle is placed in the closed configuration.

The above aspects can also be obtained by a method using the lockout devices above. These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present device, as well as the structure and operation of various embodiments of the present device, will become apparent and more readily appreciated from the following description of the preferred embodiments, taken in conjunction with the accompanying drawings of which.

DETAILED DESCRIPTION

Figure 1:
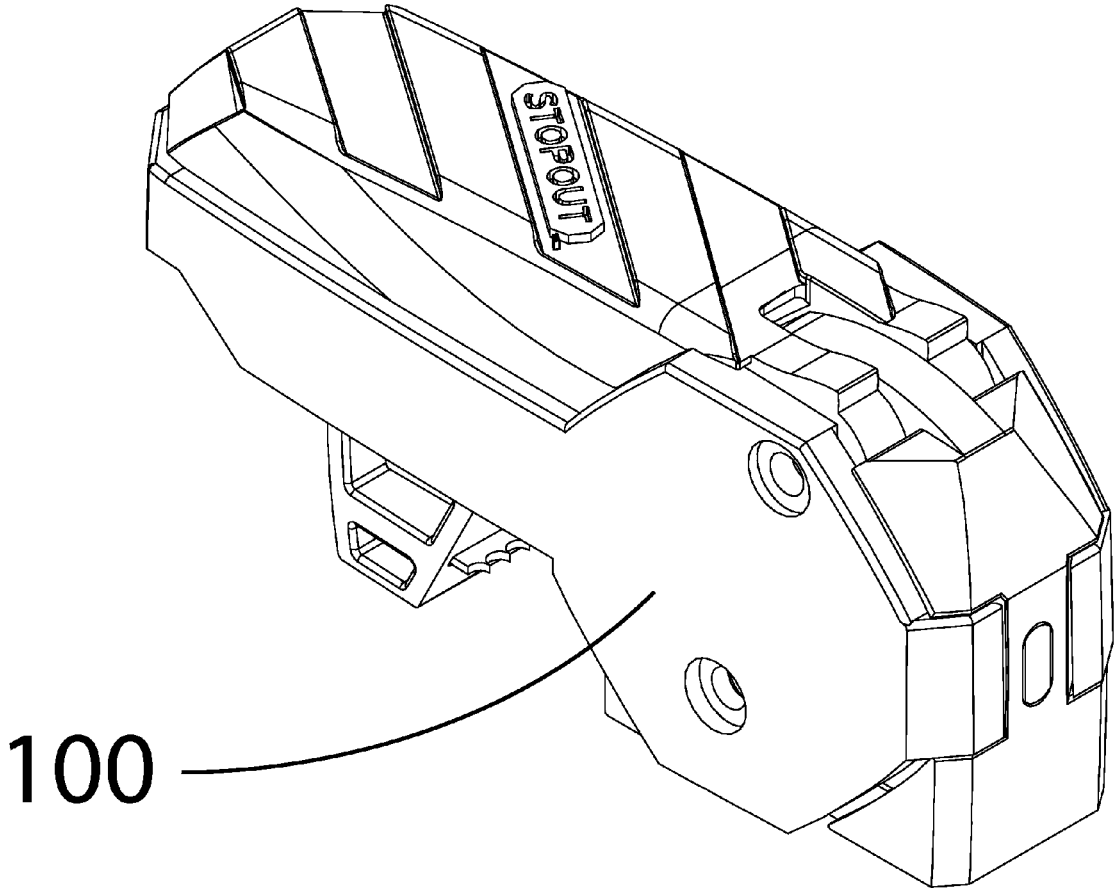
FIG. 1 is a top, front and left-side perspective view of a lockout device, shown in a closed configuration, according to an embodiment.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

The present lockout device can comprise an attachment mechanism that is similar to that used by many existing bar clamps. Specifically, the present lockout device can comprise a dual clutch plate mechanism capable of both moving a slide bar through openings located in each of the clutch plates and locking the slide bar in a particular position. In an embodiment, this dual clutch plate mechanism can be actuated by a handle and the sliding bar can be actuated by moving the handle radially about a pivot point located on the lockout device between an open configuration and a closed configuration. This attachment mechanism can be far easier to operate than those comprising other lockout devices, which require the use of a thumbscrew to initially connect the lockout device to a circuit breaker switch or similar electrical switch.

FIG. 1 is a top, front and left-side perspective view of a lockout device 100, shown in a closed configuration, according to an embodiment. The present lockout device 100 can be a clamping device configured to be securely connected to a circuit breaker switch (not pictured), or similar switch. Any lockout device that can easily become dislodged from the circuit breaker switch to which it has been attached would be completely ineffective. Therefore, this connecting capability is of paramount importance to the overall functionality of any lockout device. Here, the clamping aspect of the present lockout device 100 can be achieved by a mechanism closely resembling that of many bar clamps. Not only can this design provide an extremely secure connection between the lockout device 100 and a circuit breaker switch, it can also be easy to operate, allowing for speedy connection and removal.

Figure 2:
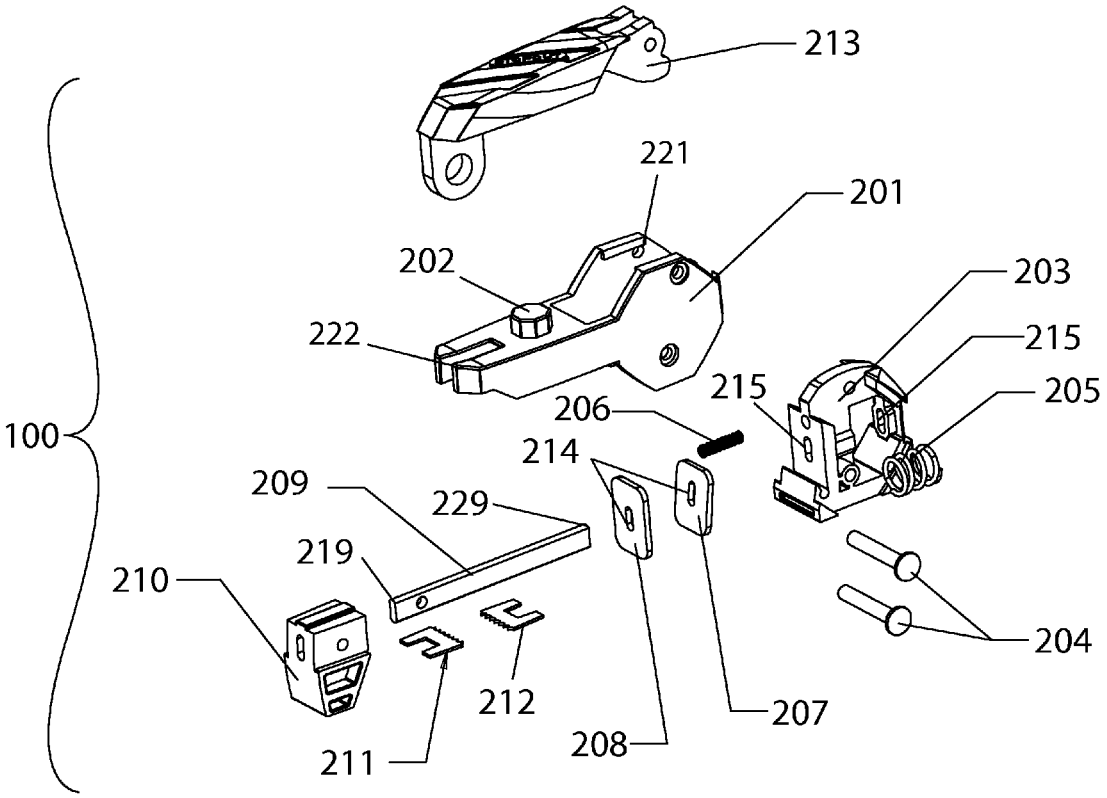
FIG. 2 is a exploded perspective view of a lockout device, according to an embodiment.

FIG. 2 is a perspective exploded view of a lockout device 100, according to an embodiment. In this figure, each of the pieces comprising a particular embodiment of the lockout device 100 can be viewed. In an embodiment, the lockout device 100 can comprise a housing 201, to which many other parts of the lockout device 100 can be connected. The housing 201 can comprise a housing opening 221 at one end and a housing slot 222 at its opposite end. The housing 201 can also comprise a peg 202, which can be configured to receive a lockout tag (not shown in FIG. 2) comprising an opening of sufficient size and shape to receive the peg 202, thus attaching the lockout tag to the lockout device 100. In an embodiment, the housing 201 can connect to a frame 203, at the housing opening 221, by rivets 204 or other similar connecting devices. The frame 203 can comprise one or more openings 215 configured to allow a sliding bar 209 to pass though the frame 203. In an embodiment, the frame 203 can be the point of connection for many of the remaining parts of the lockout device's 100 including: a large spring 205, a small spring 206, a front clutch 207, a rear clutch 208, the sliding bar 209 and frame teeth 212. A jaw 210 can be connected to the sliding bar 209 and jaw teeth 211 can be connected to the jaw 210. Both the rear clutch 208 and the front clutch 207 can comprise openings 214 near their respective centers, each opening 214 can be configured to allow the sliding bar 209 to pass though both the rear clutch 208 and the front clutch 207. The sliding bar 209 can comprise a first end 219 and a second end 229, wherein the jaw 210 can be securely connected to the first end 219 of the bar 209 and the second end 229 can be placed though the openings 214 comprising both the rear clutch 208, the front clutch 207 and the frame 203. A handle 213 can be pivotably attached to both the housing 201 and the frame 203 by one or more rivets 204 or a similar attachment device.

Figure 3:
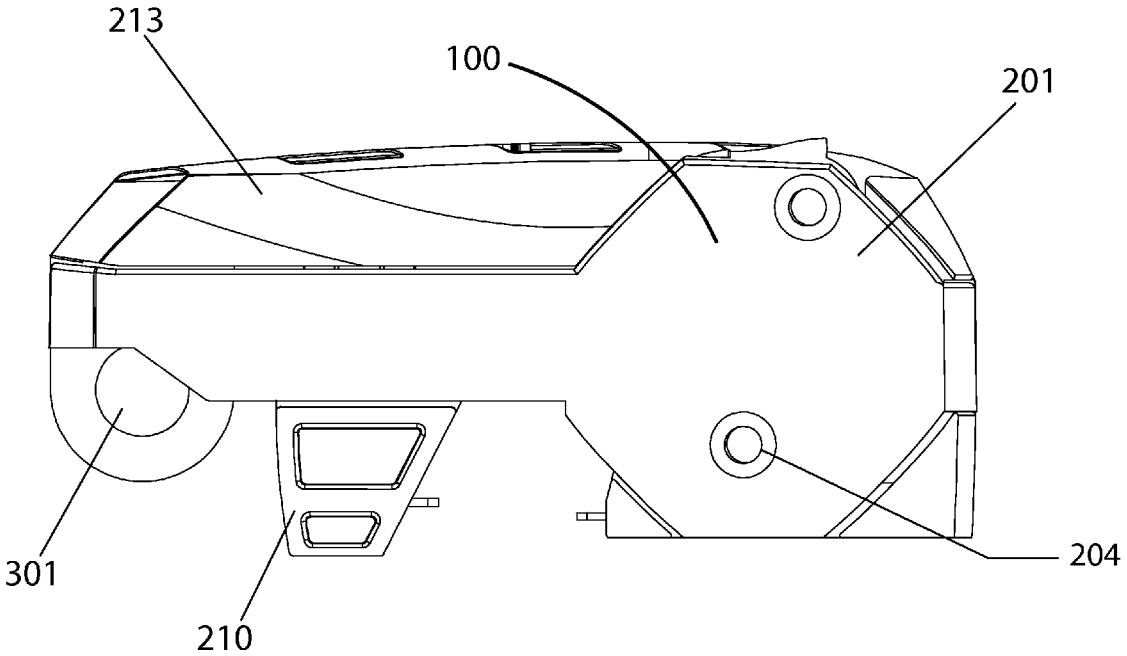
FIG. 3 is a left-side view of a lockout device, shown in a closed configuration, according to an embodiment.

FIG. 3 is a left-side view of a lockout device 100, shown in a closed configuration, according to an embodiment. After the lockout device 100 has been connected to a switch, a padlock (not pictured) can be connected to the lockout device 100 through the use of a loophole 301 comprising the handle 213, according to an embodiment. A padlock's shackle (not shown in FIG. 3) can be placed through the loophole 301 such that it cannot be removed without first unlocking the padlock. In order to secure the lockout device 100 to a circuit breaker switch, the lockout device 100 can be in placed into a closed configuration as shown in both FIGS. 1 and 3, wherein the handle 213 can be placed parallel to a back of a housing body 201 and throughout the housing slot (not shown in FIG. 3). By placing the shackle of a padlock through the loophole 301 when the lockout device 100 is in the closed configuration, the handle 213 can thus be prevented from moving in any direction relative to the housing 201.

In an embodiment, the rear clutch 208 can function as a release for the sliding bar 209. When the rear clutch 208 is placed in a position, that is roughly perpendicular to the sliding bar 209, the sliding bar 209 can be allowed to move freely through the openings 214 in the rear clutch 208 and the front clutch 207. In an embodiment, the lockout device 100, when placed in a closed configuration, can prevent access to the rear clutch 208 thus preventing the release of the sliding bar 209. Likewise, the jaw 210 can be connected to the sliding bar 209 and the jaw 210 can be prevented from moving if the sliding bar 209 has also been prevented from moving. Access to the rear clutch 208 can be prevented by moving the handle 213 parallel to, and abutted against the housing 201, thus preventing the sliding bar 209 from being released when the lockout device 100 is in a closed configuration.

Figure 4:
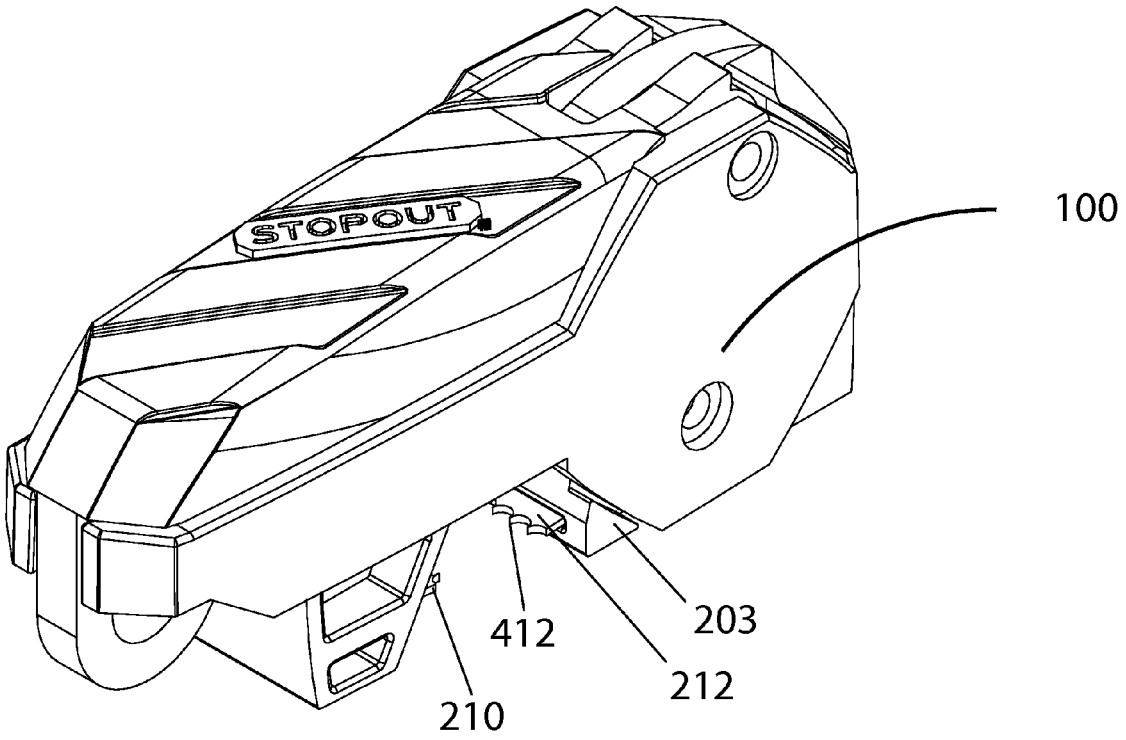
FIG. 4 is a top, rear and left-side perspective view of a lockout device, shown in a closed configuration, according to an embodiment.

FIG. 4 is a top, rear and left-side perspective view of a lockout device 100, shown in a closed configuration, according to an embodiment. In this view, the location where the frame teeth 212 can be connected to the frame 203 is clearly shown. Both the frame teeth 212 and the jaw teeth 211 (not shown in FIG. 4), can comprise serrated edges 412 configured to securely grip a circuit breaker switch (not pictured in FIG. 4). In an embodiment, the jaw 210 can be moved toward the frame 203, which causes the jaw teeth 211 to be moved toward the frame teeth 212. This can cause the circuit breaker switch to be contacted simultaneously by the jaw teeth 211 on one side of the switch and the frame teeth 212 on the opposite side of the switch, thereby securely gripping the circuit breaker switch which is not shown in FIG. 4.

Figure 5:
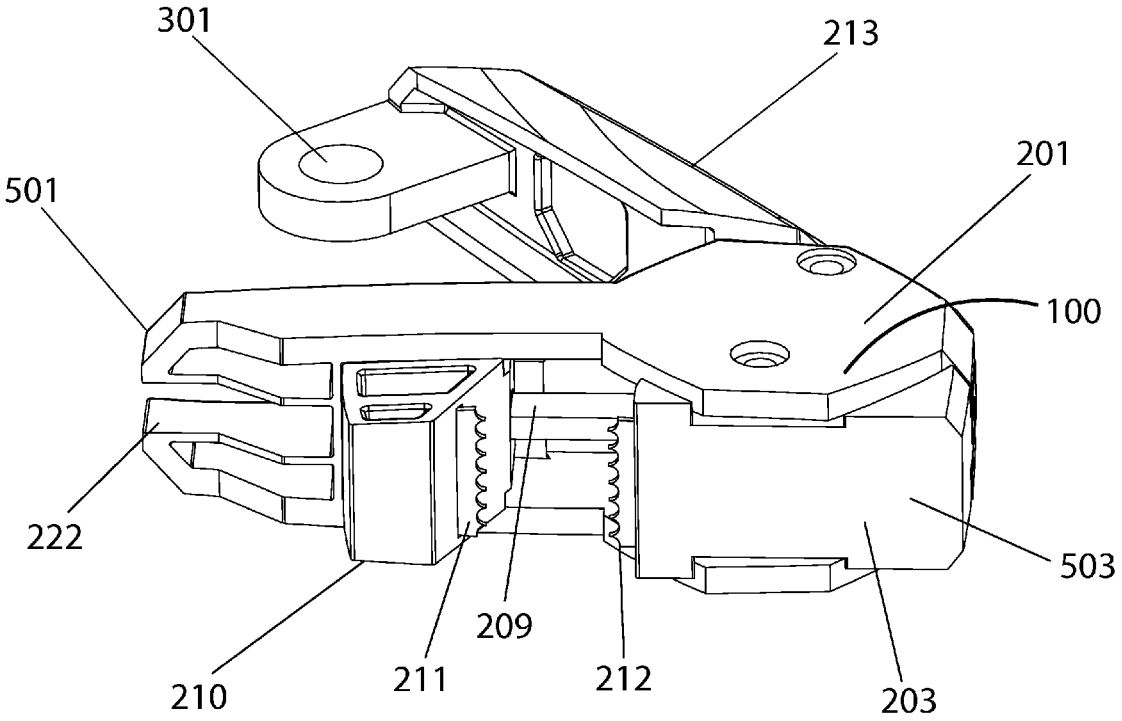
FIG. 5 is a bottom and left-side perspective view of a lockout device, shown in an open configuration, according to an embodiment.

FIG. 5 is a bottom and left-side perspective view of a lockout device 100, shown in an open configuration, according to an embodiment.

In this view, the attachment mechanism of the present lockout device 100 can clearly be viewed. The jaw 210 and jaw teeth 211 can be moved toward the frame 203 and frame teeth 212 by moving the sliding bar 209 toward the frame's front 503. Similarly, the jaw 210 and jaw teeth 211 can be moved away from the frame 203 and frame teeth 212 by moving the bar 209 toward the housing's back 501. Also clearly viewable in FIG. 5 is the housing slot 222 of the housing 201, which can be configured to receive the loophole 301 when the handle 213 is moved into the closed configuration.

Figure 6A:
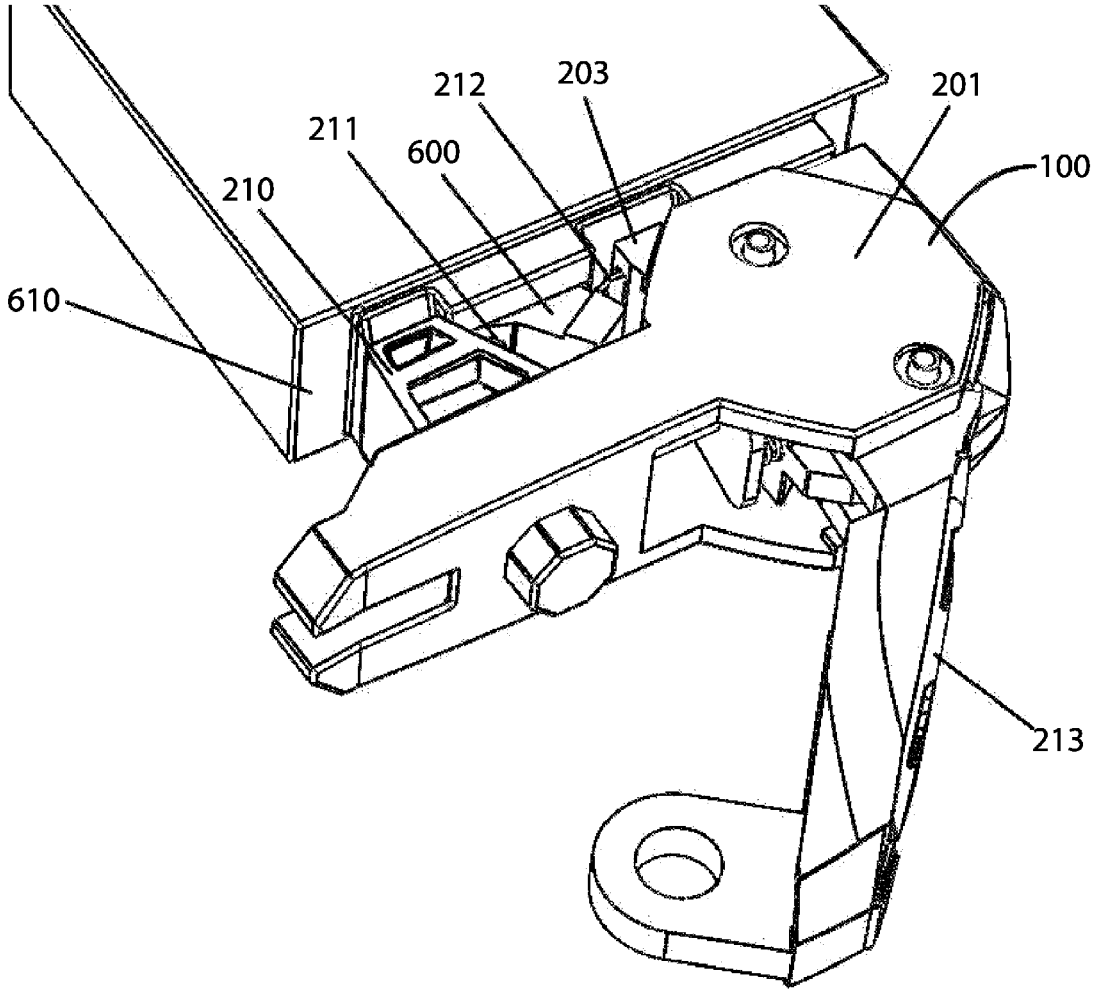
FIG. 6A is a top, rear and right-side perspective view of a lockout device, shown in an open configuration, and a circuit breaker switch, according to an embodiment.

FIG. 6A is a top and right-side perspective view of a lockout device 100, shown in an open configuration and a circuit breaker switch 600, according to an embodiment.

FIGS. 6A thru 6D depict the various stages of attachment wherein the lockout device 100 can be connected to a circuit breaker switch 600. The first step is to place the circuit breaker switch 600 between the jaw teeth 211 and the frame teeth 212 by placing the bottom of the lockout device 100 in a plane that is roughly parallel to the face of the circuit breaker 610, and roughly perpendicular to the circuit breaker switch 600. To perform this step, the jaw 210 must be located at a sufficient distance from the frame 203, which can be achieved by moving the sliding bar 209 through the rear clutch 208 and the front clutch 207. This sliding movement can be facilitated by pressing the rear clutch 208 against the frame 203, or into a plane roughly parallel to the frame 203. The handle 213 can then be pivoted down toward the housing 201 a sufficient number of times, in a ratcheting motion, so that both the jaw teeth 211 and the frame teeth 212 can be in contact with the circuit breaker switch 600. Specifically, radial movement of the handle 213 can actuate the front clutch 207 in an oscillating motion pulling the sliding bar 209 through the front clutch opening 214 and moving the jaw 210 closer to the frame 203 and the jaw teeth 211 closer to the frame teeth 212 and the rear clutch 208 can prevent the sliding bar 209 from moving the jaw 210 away from the frame 203, according to an embodiment.

Figure 6B:
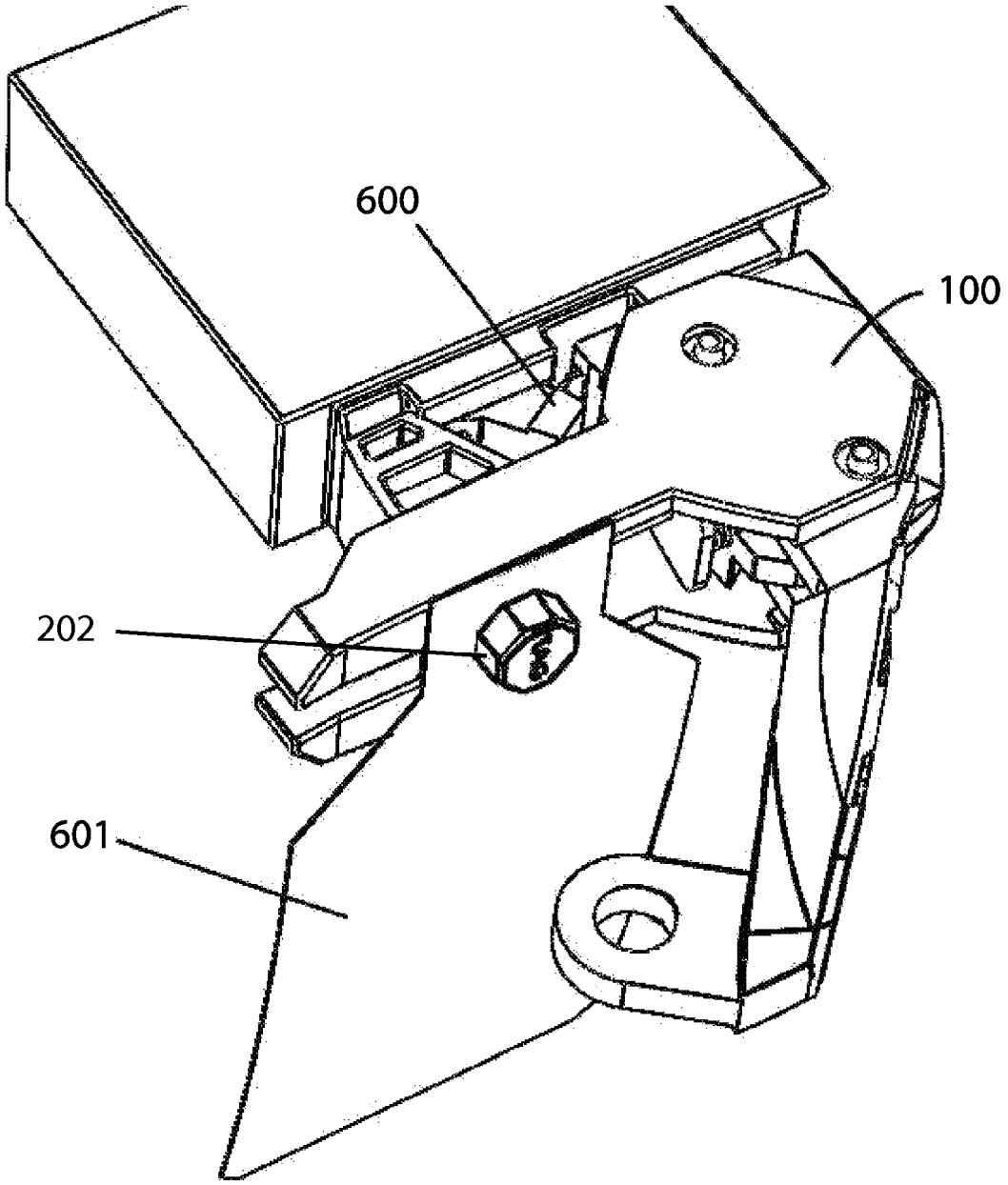
FIG. 6B is a top, rear and right-side perspective view of a lockout device, shown in an open configuration, and a circuit breaker switch, wherein a lockout tag has been connected to the lockout device, according to an embodiment.

FIG. 6B is a top and right-side perspective view of a lockout device 100, shown in an open configuration, and a circuit breaker switch 600, wherein a lockout tag 601 has been connected to the lockout device, according to an embodiment. As discussed above, the lockout tag 601 can be connected to the lockout device 100 by placing a hole in the tag over the peg 202 or similar connecting structure.

Figure 6C:
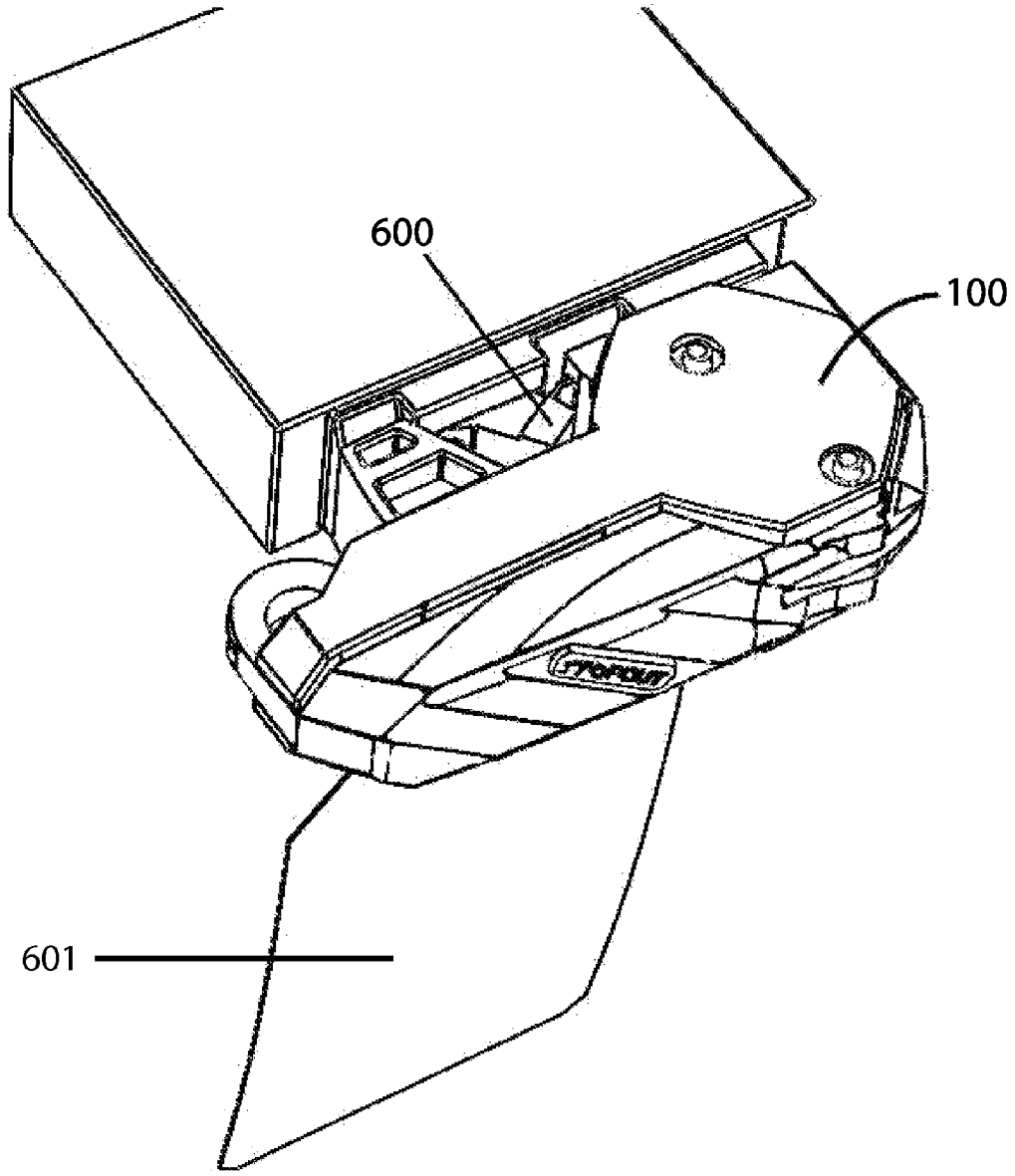
FIG. 6C is a top, rear and right-side perspective view of a lockout device, shown in a closed configuration, that has been connected to a circuit breaker switch, according to an embodiment.

FIG. 6C is a top and right-side perspective view of a lockout device 100, shown in a closed configuration, which has been connected to a circuit breaker switch 600, according to an embodiment, thus securely connecting the lockout tag 601 to the lockout device 100 so that the tag is held parallel to the lockout device 100. This position of the lockout tag 601 to the lockout device 100 can allow the tag 601 to be clearly visible to a viewer when the lockout device is connected to a switch as shown in FIG. 6C.

Figure 6D:
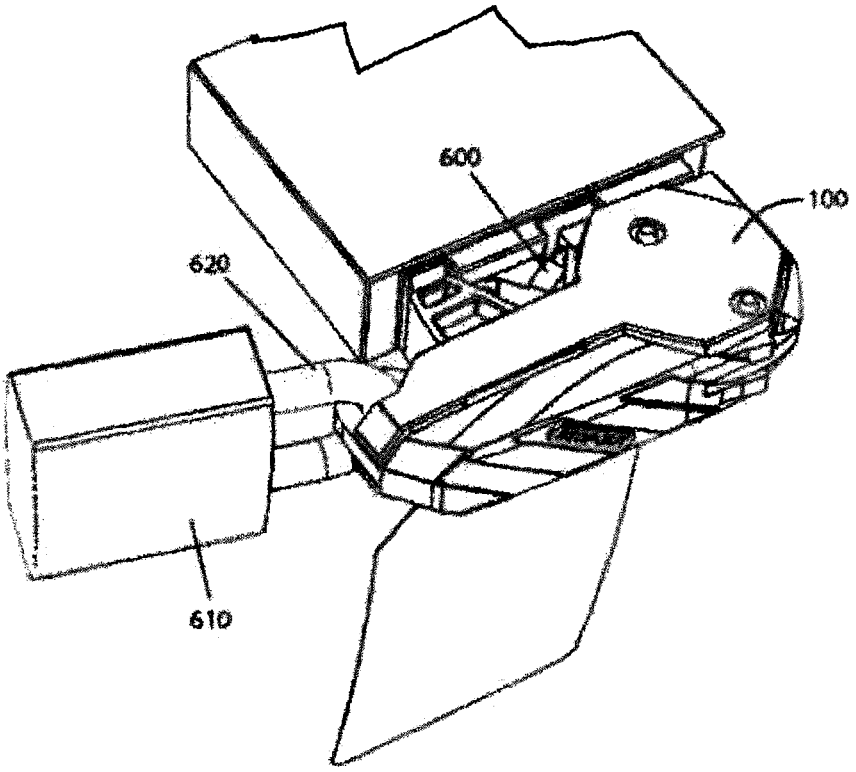
FIG. 6D is a top, rear and right-side perspective view of a lockout device, shown in a closed configuration, that has been connected to a circuit breaker switch, wherein a padlock has been connected to the lockout device, according to an embodiment.

FIG. 6D is a top and right-side perspective view of a lockout device 100, shown in a closed configuration that has been connected to a circuit breaker switch 600, wherein a padlock 610 has been connected to the lockout device 100, according to an embodiment. As discussed above, the padlock's shackle 620 can be placed through the loophole 301, as shown in FIG. 6D, such that it cannot be removed without first unlocking the padlock 610 and removing the shackle 620 from the loophole 301.

Figure 7:
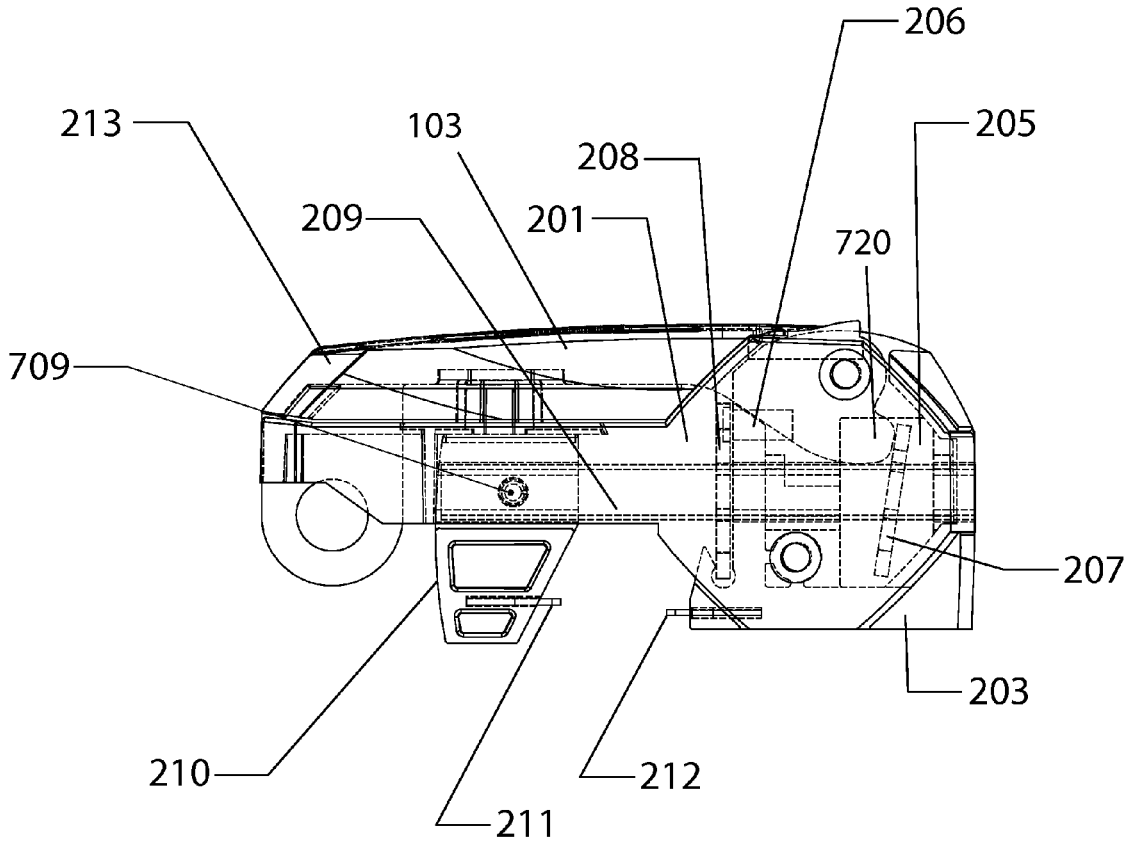
FIG. 7 is a left-side transparent view of a lockout device, shown in a closed configuration, according to an embodiment.

FIG. 7 is a side transparent view of a lockout device, shown in a closed configuration, according to an embodiment. In this view, the positions of the various parts comprising the lockout device 100 are shown as they would exist in an assembled lockout device 100, according to an embodiment. Specifically, the relative positions of the rear clutch 208 and the front clutch 207 are can be seen. Additionally, the connection of the handle 213 to the front clutch 207 is shown indicating how the front clutch 207 can be actuated by the handle 103, and specifically a cam 720 comprising the handle 103, when the handle 103 is moved back and forth between the closed configuration and the open configuration. In an embodiment, this actuation can be facilitated by the large spring 205, which can be configured so that the handle 103 will remain in the open configuration unless pressure is exerted and maintained against the handle 103 and it is moved into the closed configuration as shown in FIG. 7.

This view also shows the position of the small spring 206 which maintains pressure against the rear clutch 208, holding the sliding bar 209 in place thus preventing the jaw 210 from moving. As discussed above, pressing the rear clutch 208 toward the frame 203 and compressing the small spring 206 can release the sliding bar 203, allowing the jaw 210 to be moved either toward or away from the frame 203. In an embodiment, the jaw 210 can be connected to the sliding bar 209 using a pin 709 or similar connection device.

Figure 8:
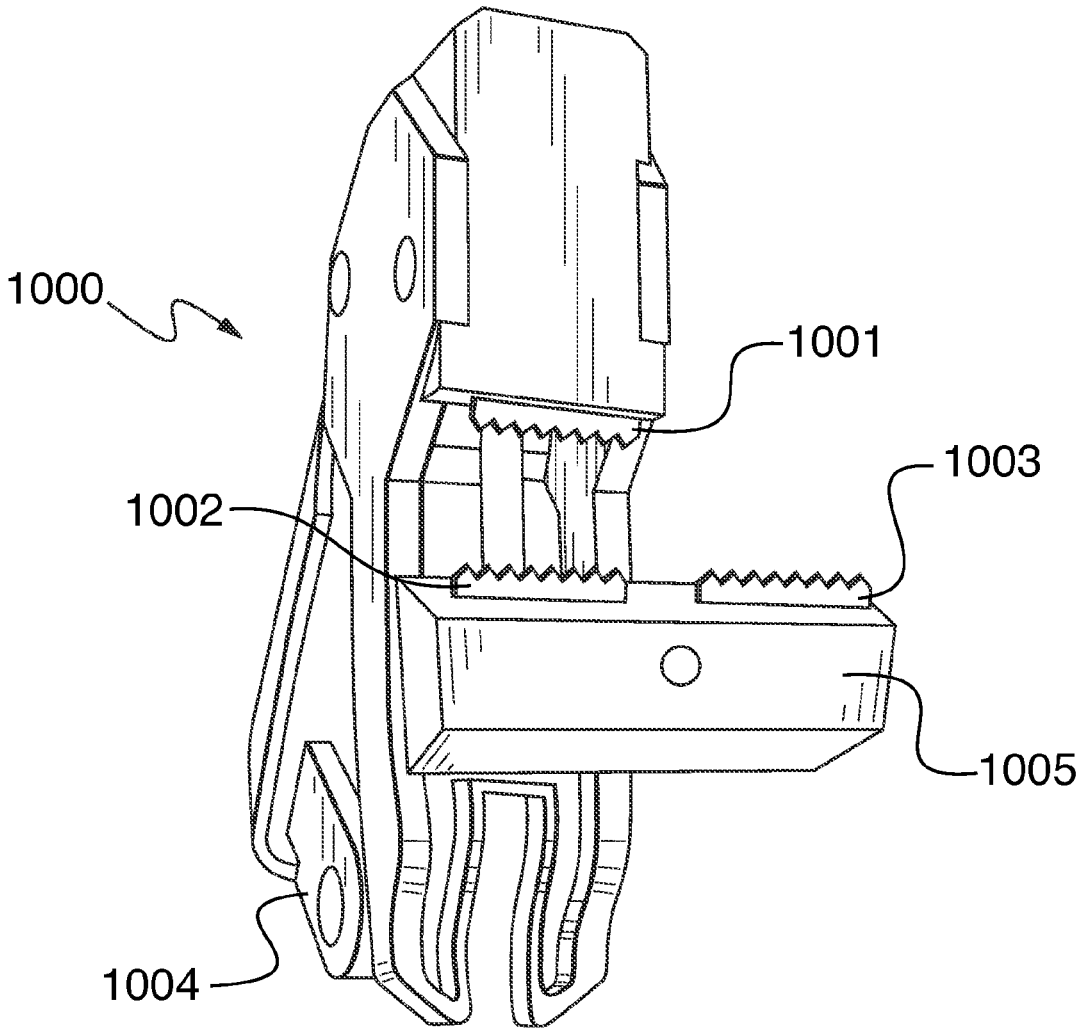
FIG. 8 is a perspective view of a double lockout device, according to an embodiment.

FIG. 8 is a perspective view of a double lockout device 1000, according to an embodiment. While the internal mechanics of the double lockout device 1000 can be similar to the previously discussed embodiments of the lockout device 100, the jaw 1005 of the double lockout device 1000 has been lengthened to provide space for a set of primary jaw teeth 1002 and secondary jaw teeth 1003. The primary set of jaw teeth 1002 can be located in a position, which is the same or similar to the jaw teeth 211 comprising the lockout device 100. The secondary jaw teeth 1003 can be positioned such that the double lockout device 1000 can prevent the accidental switching of a secondary circuit breaker switch (not shown) in addition to the primary circuit breaker switch (not shown).

Figure 9:
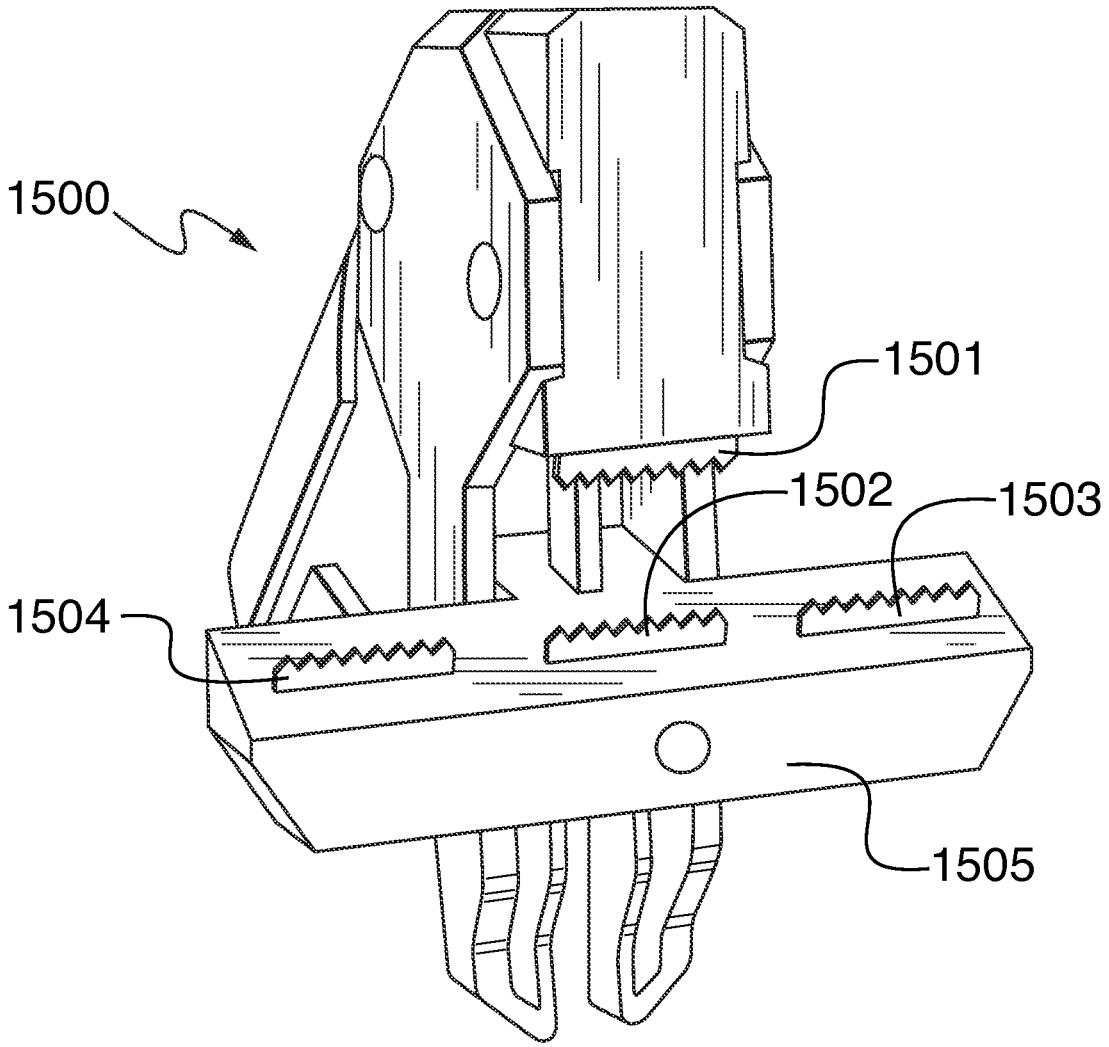
FIG. 9 is a perspective view of a triple lockout device, according to an embodiment.

FIG. 9 is a perspective view of a triple lockout device 1500, according to an embodiment. While the internal mechanics of the triple lockout device 1500 can be similar to the previously discussed embodiments, the jaw 1505 can be lengthened to provide space for a set of primary jaw teeth 1502, secondary jaw teeth 1503, and tertiary jaw teeth 1504. The secondary jaw teeth 1503 and tertiary jaw teeth 1504 can be positioned such that the triple lockout device 1500 can prevent the accidental switching of a secondary and tertiary circuit breaker switch (not shown) in addition to the primary circuit breaker switch (not shown).

Figure 10:
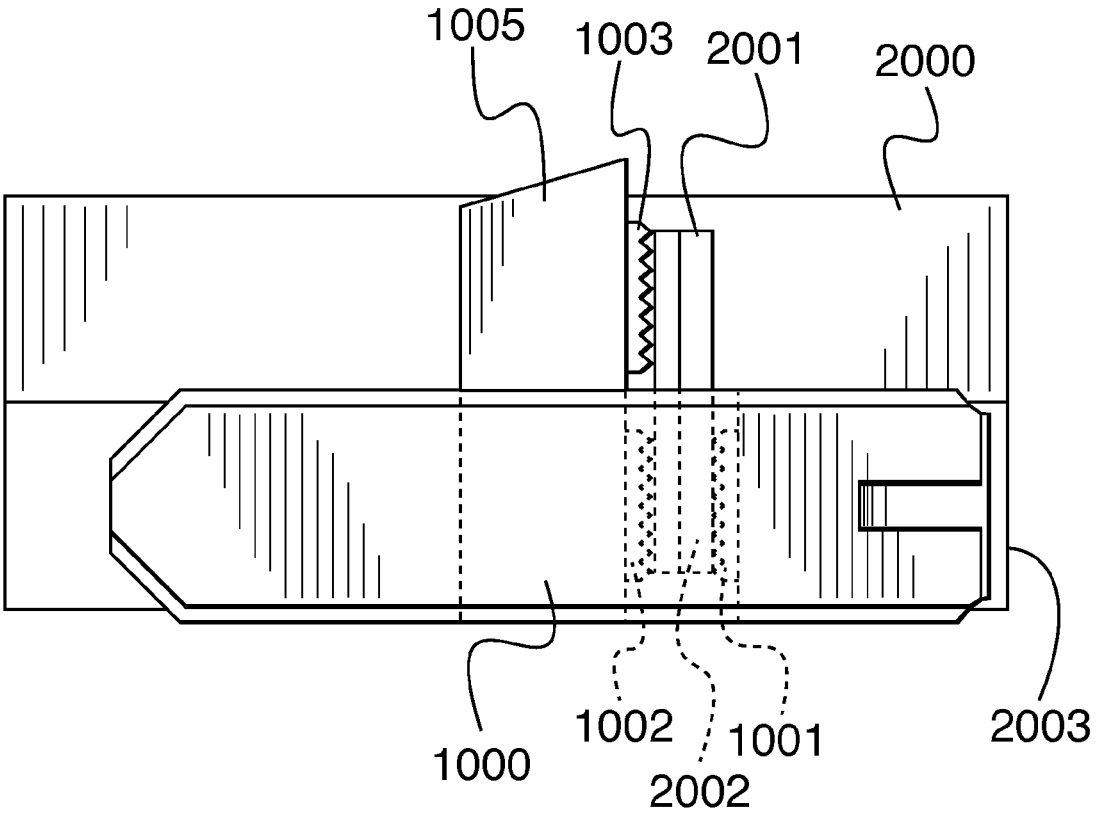
FIG. 10 is a front view of a double lockout device, shown in a closed configuration, which has been connected to two circuit breaker switches, according to an embodiment.

FIG. 10 is a front view of a double lockout device 1000, shown in a closed configuration, which has been connected to two circuit breaker switches 2001 2002, according to an embodiment. The method of connecting the double lockout device 1000 to the two circuit breaker switches 2001 2002 can be similar to the method used to connect the lockout device 100 to a single circuit breaker switch (not shown). The first step can be to place the primary circuit breaker switch 2002 between the primary jaw teeth 1002 and the frame teeth 1001 by placing the bottom of the double lockout device 1000 in a plane that is roughly parallel to the face of the primary circuit breaker 2003, and roughly perpendicular to the primary circuit breaker switch 2002. To perform this step, the jaw 1005 must be located at a sufficient distance from the frame, which can be achieved by moving the sliding bar (not shown) through the rear clutch (not shown) and the front clutch (not shown). This sliding movement can be facilitated by pressing the rear clutch against the frame, or into a plane roughly parallel to the frame. The handle can then be pivoted down toward the housing (not shown) a sufficient number of times, in a ratcheting motion, so that both the primary jaw teeth 1002 and the frame teeth 1001 can be in contact with the primary circuit breaker switch 2002. The secondary jaw teeth 1003 can be in contact with the secondary circuit breaker switch 2001. Specifically, radial movement of the handle can actuate the front clutch in an oscillating motion pulling the sliding bar through the front clutch opening and moving the jaw 1005 closer to the frame and the primary jaw teeth 1002 closer to the frame teeth 1003 and the rear clutch can prevent the sliding bar from moving the jaw 1005 away from the frame, according to an embodiment.

Figure 11:
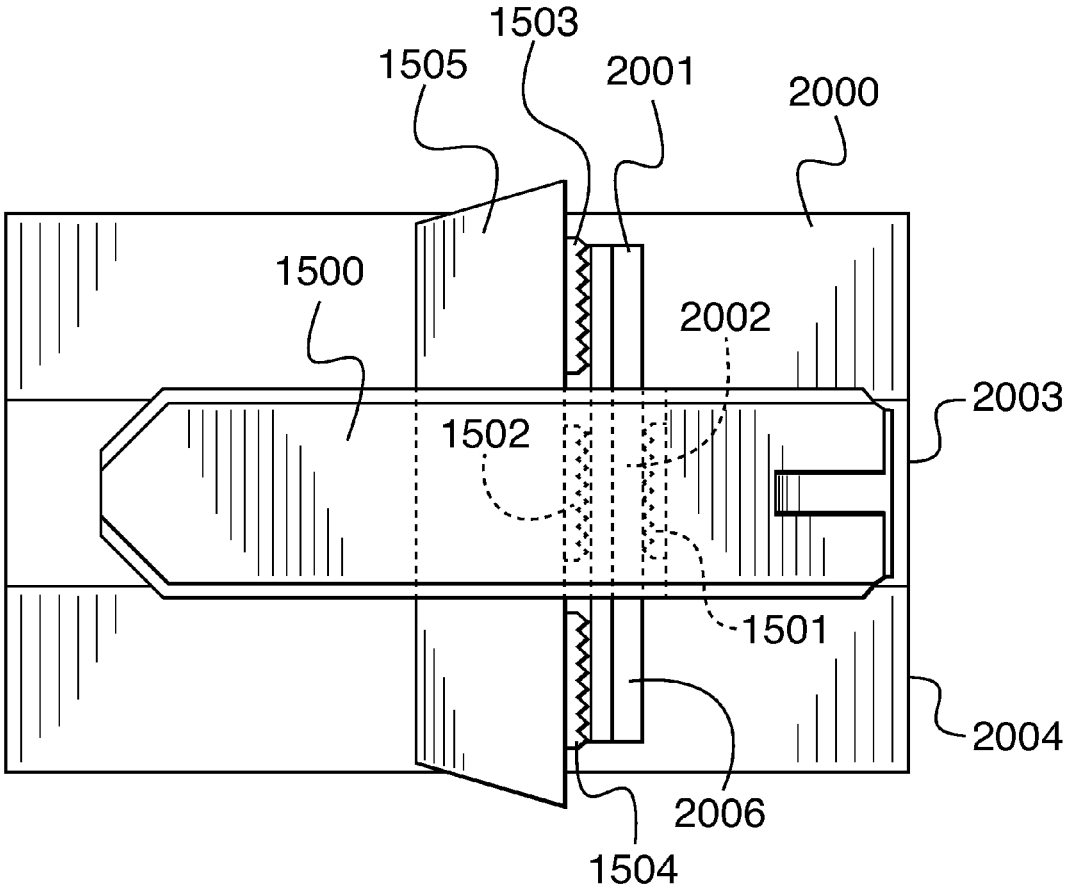
FIG. 11 is a front view of a triple lockout device, shown in a closed configuration, which has been connected to three circuit breaker switches, according to an embodiment.

FIG. 11 is a front view of a triple lockout device 1500, shown in a closed configuration, which has been connected to three circuit breaker switches 2001 2002 2006, according to an embodiment. The method of connecting the triple lockout device 1500 to the three circuit breaker switches 2001 2002 2006 can be similar to the method used to connect the lockout device 100 to a single circuit breaker switch (not shown). The first step can be to place the primary circuit breaker switch 2002 between the primary jaw teeth 1502 and the frame teeth 1501 by placing the bottom of the double lockout device 1500 in a plane that is roughly parallel to the face of the primary circuit breaker 2003, and roughly perpendicular to the primary circuit breaker switch 2002. To perform this step, the jaw 1505 must be located at a sufficient distance from the frame, which can be achieved by moving the sliding bar (not shown) through the rear clutch (not shown) and the front clutch (not shown). This sliding movement can be facilitated by pressing the rear clutch against the frame, or into a plane roughly parallel to the frame. The handle can then be pivoted down toward the housing a sufficient number of times, in a ratcheting motion, so that both the primary jaw teeth 1502 and the frame teeth 1501 can be in contact with the primary circuit breaker switch 2002. The secondary jaw teeth 1503 can be in contact with the secondary circuit breaker switch 2001, while the tertiary jaw teeth 1504 can be in contact with the tertiary circuit breaker switch 2006. Specifically, radial movement of the handle can actuate the front clutch in an oscillating motion pulling the sliding bar through the front clutch opening and moving the jaw 1505 closer to the frame and the primary jaw teeth 1502 closer to the frame teeth 1503 and the rear clutch can prevent the sliding bar from moving the jaw 1505 away from the frame, according to an embodiment.

Although the present device has been described in terms of exemplary embodiments, it is not limited thereto. Rather, the appended claims should be construed broadly, to include other variants and embodiments of the present device, which may be made by those skilled in the art without departing from the scope and range of equivalents of the present device.

What is claimed is:

1. A lockout device comprising:

a housing comprising a housing opening;

a frame located within the housing opening, wherein the frame comprises a front end further comprising a front frame opening and a rear end further comprising a rear frame opening, and the frame further comprising a rear clutch comprising a rear clutch opening connected to the rear end of the frame and a front clutch comprising a front clutch opening connected to the front end of the frame;

a sliding bar having a first end and a second end, wherein a jaw, having primary jaw teeth and secondary jaw teeth, is connected to the first end of the sliding bar and the second end of the slide bars configured to pass through the front clutch opening, the front frame opening, then the rear clutch opening, and the rear frame opening; and a handle having a first end and a second end, wherein the first end is pivotably connected to both the housing and the frame and is configured to move between an open configuration and a closed configuration, wherein movement of the handle from the open configuration to the closed configuration causes the jaw to move toward the frame.

2. The lockout device described in claim 1 wherein the handle comprises a loophole at its second end configured to accept a padlock shank.

3. The lockout device described in claim 2 wherein the loophole is configured such that placing the padlock shank through the loophole when the lockout device is in a closed configuration prevents the handle from moving into the open configuration.

4. The lockout device described in claim 1 wherein the rear clutch acts as a release when moved into a position roughly perpendicular to the sliding bar, allowing the sliding bar to pass through a rear clutch opening.

5. The lockout device described in claim 1 wherein the housing comprises a peg configured to receive a lockout tag hole.

6. The lockout device described in claim 5 wherein the handle is configured to lock a lockout tag onto the peg when the handle is in the closed configuration.

7. The lockout device as described in claim 4 wherein the handle is configured to prevent access to the rear clutch when the handle is in the closed configuration.

8. The lockout device described in claim 1 wherein the frame comprises frame teeth.

9. The lockout device described in claim 8 wherein the primary jaw teeth, secondary jaw teeth, and frame teeth comprise a serrated metal edge.

10. The lockout device described in claim 1 wherein the jaw further comprises tertiary jaw teeth.

11. The lockout device as described in claim 10 wherein the primary jaw teeth, secondary jaw teeth, tertiary jaw teeth, and frame teeth comprise a serrated metal edge.

12. A lockout device comprising:

a housing having a first end comprising a housing opening and a second end comprising a housing slot;

a frame connected to the first end of the housing and located within the first housing opening, wherein the frame comprises a front end comprising an opening and a rear end comprising an opening, wherein frame teeth are connected to the rear end of the frame;

a rear clutch, comprising an opening, located near the rear end of the frame and a front clutch, comprising an opening, located near the front end of the frame;

a large spring located within the frame, the large spring configured to push the handle away from the frame thus holding the lockout device in an open configuration;

a small spring located between the rear clutch and the rear end of the frame, the small spring configured to push the rear clutch away from the rear end of the frame;

a sliding bar having a first end and a second end, wherein a jaw comprising primary jaw teeth and secondary jaw teeth is connected to the first end of the slide bar and the second end of the slide bar is configured to pass through openings in the rear clutch, rear frame, front clutch, and front frame; and a handle having a first end and a second end, wherein the first end is pivotably attached to both the housing and the frame and is configured to move between an open configuration and a closed configuration, and wherein movement of the handle from the open configuration to the closed configuration causes the jaw to move toward the frame, and wherein a loophole, located at the second end of the handle is configured to pass through the housing slot when the handle is placed in the closed configuration.

13. The lockout device described in claim 12 wherein the loophole is configured to accept a padlock shank when the handle is placed in the closed configuration.

14. The lockout device described in claim 12 wherein the rear clutch acts as a release when moved into a position roughly perpendicular to the sliding bar, allowing the sliding bar to pass through the rear clutch opening and allowing the first end of the sliding bar to move away from the frame.

15. The lockout device described in claim 12 wherein the housing comprises a peg configured to receive a lockout tag hole.

16. The lockout device described in claim 15 wherein the handle is configured to securely connect a lockout tag onto the peg when the handle is placed in a closed configuration.

17. The lockout device described in claim 12 wherein the primary jaw teeth and secondary jaw teeth comprise a serrated metal edge and the frame teeth comprise a serrated metal edge and the serrated metal edge of the primary jaw teeth faces the serrated metal edge of the frame teeth.

18. The lockout device described in claim 12 wherein the jaw further comprises tertiary jaw teeth.

19. The lockout device described in claim 18 wherein the primary jaw teeth, secondary jaw teeth, and tertiary jaw teeth comprise a serrated metal edge and the frame teeth comprise a serrated metal edge and the serrated metal edge of the primary jaw teeth faces the serrated metal edge of the frame teeth.

20. A method for using a lockout device, the method comprising:

providing a lockout device comprising: a housing having a first end further comprising a housing opening and a second end further comprising a housing slot, wherein a peg is located between the housing opening and the housing slot; a frame connected to the first end of the housing and located within the housing opening, wherein the frame comprises a front end further comprising a front frame opening and a rear end further comprising a rear frame opening, and the frame comprising a rear clutch comprising a rear clutch opening connected to the rear end of the frame and a front clutch comprising a front clutch opening connected to the front end of the frame and frame teeth connected to the rear end of the frame; a large spring located within the frame, the large spring configured to push the handle up, holding the lockout device in an open configuration; a small spring located between the rear clutch and the rear end of the frame, the small spring configured to push the rear clutch away from the rear end of the frame; a slide bar having a first end and a second end, wherein a jaw comprising primary jaw teeth and secondary jaw teeth connects to the first end of the slide bar and the second end of the slide bar is configured to pass through the rear clutch opening, the rear frame opening, the front clutch opening, and the front frame opening; and a handle having a first end and a second end, wherein the first end is pivotably connected to both the housing and the frame, and wherein movement of the handle from the open configuration to the closed configuration actuates the front clutch in an oscillating motion pulling the sliding bar through the front clutch opening thus moving the jaw closer to the frame and the jaw teeth closer to the frame teeth and the rear clutch is configured to prevent the sliding bar from moving the jaw away from the frame; and wherein the second end of the handle comprises a loophole, wherein the loophole passes through the housing slot when the second end of the handle is placed in the closed configuration;

providing a circuit breaker switch;

providing a secondary circuit breaker switch providing a padlock comprising a shank;

providing a lockout tag comprising a hole configured to receive the peg; and placing the lockout device over a circuit breaker switch so that the circuit breaker switch is located between the primary jaw teeth and the frame teeth;

moving the handle from the open configuration to the closed configuration a sufficient number of times to move the jaw toward the frame until both the primary jaw teeth and the frame teeth contact the circuit breaker switch, the secondary jaw teeth contact the secondary circuit breaker switch, and the lockout device is in an open configuration;

placing the peg through the lockout tag's hole thus connecting the lockout tag to the lockout device;

placing the lockout device in a closed configuration wherein the loophole has been placed through the housing slot; and placing the shank of a padlock through a loophole thus preventing the handle from moving into an open configuration and locking the padlock onto the loophole and lockout device.

21. The method for using a lockout device as described in claim 20, further comprising:

the providing a lockout devices further comprises a jaw further comprising tertiary jaw teeth;

providing a tertiary circuit breaker switch, and;

the moving the handle further comprises the tertiary jaw teeth contacting the tertiary circuit breaker switch.

22. The method for using a lockout device as described in claim 20 wherein the lockout device can be removed from the circuit breaker switch by:

unlocking the padlock and removing the shank from the loophole;

placing the handle into an open configuration and removing the lockout tag from the peg;

placing the rear clutch plate into a position perpendicular to the sliding bar and releasing the sliding bar;

moving the jaw away from the frame and the primary jaw teeth away from the frame teeth; and removing the lockout device from the switch.

23. The method for using a lockout device as described in claim 20 wherein access to the rear clutch plate is prevented when the handle is placed in the closed configuration.

24. The method for using a lockout device as described in claim 20 wherein the lockout tag is prevented from being removed from the peg when the handle is placed in the closed configuration.

* * * * *